US007201102B1

(12) United States Patent
Wiedemer et al.

(10) Patent No.: US 7,201,102 B1
(45) Date of Patent: Apr. 10, 2007

(54) METHOD AND PRINTER DEVICE FOR TRANSFERRING PRINTING FLUID ONTO A CARRIER MATERIAL AS WELL AS APPERTAINING PRINTING DRUM

(75) Inventors: Manfred Wiedemer, Ismaning (DE); Martin Schleusener, Zomeding (DE); Martin Berg, München (DE)

(73) Assignee: Oce Printing Systems GmbH, Poing (DE)

( * ) Notice: Subject to any disclaimer, the term of this patent is extended or adjusted under 35 U.S.C. 154(b) by 1043 days.

(21) Appl. No.: 10/009,160

(22) PCT Filed: Jun. 28, 2000

(86) PCT No.: PCT/EP00/06028

§ 371 (c)(1),
(2), (4) Date: Dec. 6, 2001

(87) PCT Pub. No.: WO01/02171

PCT Pub. Date: Jan. 11, 2001

(30) Foreign Application Priority Data

Jun. 30, 1999 (DE) ..... 199 30 127

(51) Int. Cl.
*B41F 33/00* (2006.01)

(52) U.S. Cl. ..... 101/483; 101/484

(58) Field of Classification Search ..... 101/483, 101/484, 487, 91, 92; 347/103, 91, 66, 33, 347/22
See application file for complete search history.

(56) References Cited

U.S. PATENT DOCUMENTS

| | | | | |
|---|---|---|---|---|
| 3,545,374 | A * | 12/1970 | Hendricks, Jr. | 347/127 |
| 3,655,379 | A * | 4/1972 | Gundlach | 250/315.3 |
| 4,275,290 | A | 6/1981 | Cielo et al. | |
| 4,627,346 | A * | 12/1986 | Dietzell et al. | 101/170 |
| 4,675,694 | A * | 6/1987 | Bupara | 347/61 |
| 4,737,803 | A * | 4/1988 | Fujimura et al. | 347/67 |
| 4,748,458 | A * | 5/1988 | Inoue et al. | 347/67 |
| 4,855,768 | A * | 8/1989 | Iino et al. | 347/55 |
| 5,745,128 | A | 4/1998 | Lam et al. | |
| 5,760,808 | A * | 6/1998 | Wiedemer | 347/103 |
| 5,856,836 | A | 1/1999 | Silverbrook | |
| 5,886,722 | A | 3/1999 | Kuehnle | |
| 6,241,344 | B1 * | 6/2001 | Machida | 347/66 |

FOREIGN PATENT DOCUMENTS

| | | |
|---|---|---|
| DE | 197 18 906 | 9/1999 |
| WO | WO 95/2910 | 11/1995 |
| WO | WO95/29063 | 11/1995 |

* cited by examiner

*Primary Examiner*—Anthony H. Nguyen
(74) *Attorney, Agent, or Firm*—Schiff Hardin LLP

(57) ABSTRACT

The invention relates to a method according to which print data determine the image elements of a printing format to be printed on a substrate. According to the inventive method, the surface tension of a printing liquid (30, 34) is influenced depending on the printing date that pertains to the respective image element.

12 Claims, 4 Drawing Sheets

METHOD AND PRINTER DEVICE FOR TRANSFERRING PRINTING FLUID ONTO A CARRIER MATERIAL AS WELL AS APPERTAINING PRINTING DRUM

BACKGROUND OF THE INVENTION

The invention is directed to a method wherein print data define the picture elements of a print image to be printed onto the carrier material. Water-based or solvent-based, chromatic fluids are employed as a printing fluid. The carrier material, for example, is white paper or plastic film. The print data contain one or more bit places per picture element. For example, the value one in a bit place indicates that a black picture element is to be printed. The value zero in a bit place indicates that no printing fluid is to be applied on the picture element. The picture element retains the color of the carrier material.

European Letters Patent EP 0 756 566 B1 discloses a thermoelectric printing unit for transferring an ink onto a recording medium. The printing unit contains a printing drum with print elements arranged matrix-like that respectively contain a depression for the acceptance of ink. The ink is introduced into the depressions from the outside. A heating element, with the assistance of which the ink is expelled upon vapor formation dependent on the print data, is located in each depression.

U.S. Pat. No. 4,275,290 discloses a thermoelectric ink printing unit wherein ink is heated in depressions, whereupon surface tension and volume change. The ink flows into widened portions arranged opposite a recording medium. A meniscus forming thereat inks the recording medium.

Further, U.S. Pat. No. 4,675,694 discloses a thermoelectric ink printing unit wherein solid ink is heated. After becoming molten, the ink expands and moistens a recording medium in character-dependent fashion.

DE-A1-19718906, which does not enjoy prior publication, likewise discloses a thermoelectric ink printing unit having a hollow drum with depressions arranged thereon in matrix-like fashion. A gas bubble is generated in the ink via a laser, whereupon the ink expands and moistens a recording medium.

SUMMARY OF THE INVENTION

An object of the invention is to specify a further method for transferring printing fluid onto a carrier material. Moreover, a printer device and a printing drum are to be recited that are suitable for the implementation of the method.

According to the method and system of the invention for transferring printing fluid onto a carrier material, with print data defining picture elements of a print image to be printed onto the carrier material. A surface tension of a prescribed volume of a printing fluid is influenced when printing a picture element dependent on the print data belonging to the picture element wherein without significant change in volume, the printing fluid has either a first surface tension which moistens the carrier material or has a second surface tension deviating for the first surface tension, the printing fluid having the second surface tension not touching the carrier material.

The invention proceeds on the basis of the perception that, given a modification of the surface tension of a fluid that adjoins a solid body, a wetting angle defined by the boundary surface tension between the surface of the fluid and the seating surface and by the seating surface itself likewise changes. When the fluid is located in a vessel, then the change of the wetting angle forces a change in curvature on the surface of the fluid. The change in curvature results in at least sub-areas of the surface moving by a specific differential distance, for example rising or lowering. The differential distance is dependent on the vessel size and amounts, for example, to 10 μm through 30 μm given a print resolution of 600 dpi (dots per inch). When the carrier material lies against an acceptance unit for transporting the printing fluid for the individual picture elements or when the carrier material is arranged at a distance from the printing fluid that corresponds to the differential distance, then, dependent on the surface tension given a large wetting angle or great curvature, a moistening and thus an inking of the carrier material occurs when the printing fluid advances up to the carrier material. When, however, the wetting angle or the curvature is small, then the printing fluid does not reach the carrier material, and the carrier material retains its base color in the region lying opposite the printing fluid.

According to this principle, the surface tension of a printing fluid is influenced in the inventive method when printing a picture element, being influenced dependent of a print datum belonging to the corresponding picture element. The carrier material to be printed is arranged at a distance from the printing fluid where printing fluid having a first surface tension moistens the carrier material and where printing fluid having a second surface tension deviating from the first surface tension does not moisten the carrier material. The variation of the surface tension to be implemented in the inventive method requires far less energy than the acceleration of a drop of ink. In the inventive method, the printing fluid—after the moistening of the carrier material—proceeds to the carrier material due to the adhesion effect between carrier material and printing fluid.

In a development of the inventive method, the first surface tension is greater than the second surface tension. The curvature of the surface deriving given the first surface tension is greater than the curvature deriving given the second surface tension. A central sub-area of the printing fluid thus projects farther out given the first surface tension than given the second surface tension.

In a next development of the inventive method, the first surface tension has a first value at which the surface of the printing fluid arcs outward. The second surface tension, in contrast, has a value at which the surface of the printing fluid is flat or even arcs inward. The direction of the arc is thereby seen proceeding from the inside of the fluid. The differential distance given this development is very large, so that it is possible to conduct the carrier material past at a greater spacing from a vessel for the acceptance of the printing fluid. An abrasion of the carrier material and a wear at the edges of the vessel are thus avoided. When the printing fluid arcs inward at the second surface tension, then the carrier material can be placed against the edge of a vessel for the acceptance of the printing fluid.

In one development of the inventive method, the surface tension is varied in that the temperature of the printing fluid is varied. The heating of the fluid usually leads to a reduction of the surface tension. Photoflash lamps, laser beams or laser diodes are employed as heat sources. When fluid additive such as, for example, tensides contained in the printing fluid evaporate given variation of the temperature, then this leads to an increase in the surface tension. Tensides are surface-active substances that reduce the surface tension. An increase in the surface tension consequently arises when these fluid additives are removed. An evaporation of the tensides can already be compelled due to a relatively small temperature change. The surface tension rises more sharply due to the removal of the fluid additives than it drops due to the heating. In this opposed process, thus the increase in the surface tension dominates, this leading to an increase in the wetting angle and, thus to an increase of the curvature on the surface of the printing fluid.

In another development, the surface tension is varied due to a variation of the ionization in the printing fluid. The ionization can be varied by introducing ionized particles or by means of electrical fields as well. The variation of the ionization also enables the use of heat-sensitive printing fluids.

In one development of the inventive method, the surface tension of a prescribed volume of the printing fluid is varied. The printing fluid to be employed per picture element can be exactly prescribed with the assistance of the prescribed volume. In a next development, the volume is dimensioned such that is corresponds to the printing fluid volume to be applied onto a picture element having the color of the printing fluid. All of the prescribed printing fluid is thus employed. This leads to a thrifty printing event. Collecting printing fluid that is not needed is eliminated.

When, in another development, the volume is prescribed by the capacity volume of a depression, then the filling of the volume is simple since the printing fluid runs over the edge of the depression as soon as the depression has been filled with printing fluid. The quantity of fluid to be employed per picture element is exactly prescribed by the capacity volume of the depression and is independent of the printing speed. Since, following a stripping of fluid residues projecting beyond the depression, the printing fluid is topically limited by the edge of the depression, the boundaries of the picture elements can be precisely prescribed. The depression forms a vessel that is very well-suited for producing an optimally great differential distance on the surface of the printing fluid given a change of the surface tension.

In a next development of the inventive method, the depressions are arranged in matrix-like fashion, preferably on a drum-shaped surface. The resolution of the printer device is prescribed by the spacing and the diameter of the depressions, i.e. the plurality of picture elements to be printed per unit of area.

In a development of the inventive method, the surface tension is influenced due to the action of a radiation source directed through the opening of the depression into the inside of the depression. This development is based on the perception that the surface tension changes with a certain inertia. It is thus possible to first set the surface tension and to subsequently transport the printing fluid to the carrier material. The surface tension remains unmodified during the transport, so that the carrier material is moistened or remains unmoistened dependent on the surface tension. In this development, the radiation of the radiation source reaches the surface of the fluid without having to pass through the fluid first. The direct irradiation of the surface results in fluid additives located at the surface of the fluid being influenced with a lower amount of energy. For example, the fluid additives are tensides that evaporate given a slight increase in temperature. In this development, the radiation source is arranged outside the vessel for the printing fluid. This results in no built-in parts being needed in the material of the vessel for the delivery of the energy.

In a next development, the surface tension is modified with the assistance of a temporally and topically drivable radiation source. When the radiation source is clocked according to a timing clock, then the surface tension can be successively set for various picture elements. When a plurality of radiation sources are arranged next to one another, then the surface tensions of various picture elements can be simultaneously set. Given a combination of a temporally and topically driven radiation source, the printing speed can be increased upon employment of reasonable clock rates when, for example, radiation sources for exposing the picture elements of two or more lines are arranged behind one another and are simultaneously actuated.

In one development of the inventive method, the printing fluid for all picture elements initially has a lower surface tension that is raised dependent on the print data. The increase in the surface tension can be realized in a simple way, for example by evaporating tensides contained in the printing fluid or by introducing ions into the printing fluid. In this development, the surface tension need not be reduced during printing. However, methods are also applied wherein the printing fluid for all picture elements initially has a higher surface tension and is then reduced dependent on the print data when certain printing fluids are employed for which the reduction of the surface tension is easier to implement than the increase of the surface tension.

The inventive printer device serves for the implementation of the inventive method and the developments thereof. The technical effects recited above thus also apply to the printer device.

In one development of the inventive printer device, a unit for modifying the surface tension contains a radiation source that generates thermal radiation and/or electromagnetic radiation and/or a particle beam. When the unit for modifying the surface tension is arranged outside the receptacle unit for the printing fluid, then this receptacle unit can be constructed in a simple way. The invention is also directed to a printing drum for the application of a printing fluid. Depressions for the acceptance of the printing fluid are arranged in matrix-shaped fashion on the printing drum. The printing drum is free of devices allocated to individual depressions for influencing a physical property of the printing fluid in the respective depression. This means that there are no heating elements or similar elements for delivering energy within the printing drum. The printing drum can be homogeneously made of a uniform material. Regions of the surface of the printing drum in which no depressions lie can be coated with a hydrophobic coating in order to prevent a wetting with printing fluid at these locations.

Exemplary embodiments of the invention are explained below on the basis of the enclosed drawings.

DESCRIPTION OF THE PREFERRED EMBODIMENTS

Figure 1:
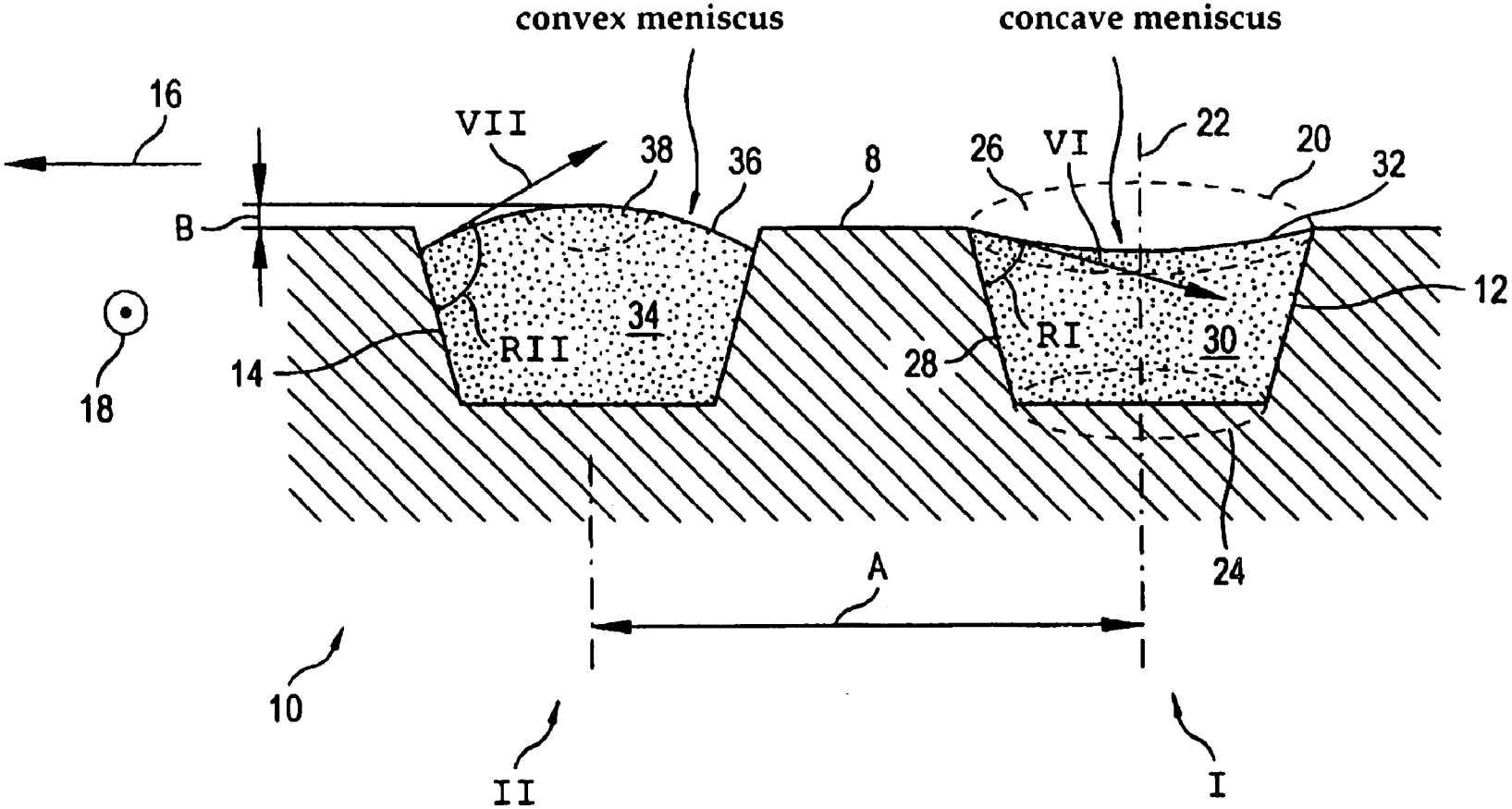
FIG. 1 illustrates a portion of a printing drum.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

FIG. 1 shows a longitudinal section along the surface 8 of a printing drum 10. A plurality of depressions are arranged in matrix-like fashion in the surface 8 of the printing drum 10, FIG. 1 showing two depressions 12 and 14 thereof. The depressions are arranged next to one another in a row direction. Neighboring depressions 12, 14 have a spacing A from one another that defines the resolution of the printer. A plurality of rows of depressions are arranged behind one another in column direction 18, whereby neighboring depressions within a column also have the spacing A from one another. The depressions are all identically constructed, so that only the structure of the depression 12 shall be explained below.

The depression 12 is designed as a conoidal frustum-shaped recess (see contour 20) and thus has circular cross-sections. The axis of the conoidal frustum lies in the direction of the normal of the surface 8. The conoidal frustum-shaped contour 20 tapers with increasing distance from the surface 8 of the printing drum 10. A bottom surface 24 of the depression 12 has a smaller diameter than the aperture 26 of the depression 12 lying on the surface of the printing drum 10. The circumference of the aperture 26 lies on a circle and determines the shape of the picture elements to be printed.

An all-around sidewall of the depression 12 is obliquely arranged relative to the surface 8 of the printing drum 10. The filling of a chromatic ink 30 is facilitated by the conoidal frustum-shaped design of the depression 12. In addition to conoidal frustum-shaped depressions having a circular cross-section, depressions with an elliptical or a polygonal cross-section are also employed.

When the ink 30 is situated within the depression, it is held within the depression 12 by capillary forces. The capillary forces are greater than the force of gravity exerted on the ink 30, so that the ink 30 also remains within the depression 12 when the aperture 26 is directed down, i.e. toward the center of the earth. After the ink 30 has been filled in, the surface 32 thereof has a surface tension that leads to a concave curvature, i.e. the surface 36 of the ink 30 is arced inward. The surface 32 is in a condition I wherein a wetting angle RI has a value of approximately 45°. The wetting angle lies between a vector V1 of the surface tension on the surface of ink 30 and the sidewall 28. The vector V1 begins at the edge of the depression 12, i.e. at a location at which the boundary between fluid 30 and sidewall 28 or surface 8 lies.

The volume capacity of the depression 12 is selected such that exactly that quantity of ink 30 that is required for printing a single picture element can be held therein. How a condition II of the surface 36 of the ink influences the printing event shall be explained below on the basis of a printing fluid 34 within the depression 14. The ink 34 also had an inwardly arced, i.e. concave, surface after being filled into the depression 14. The surface tension of the ink 34, however, was increased as a result of one of the techniques explained below on the basis of FIGS. 2 through 4, as a result whereof the surface 36 is arced outward in convex fashion. A wetting angle RII between a surface tension vector VII and the sidewall of the depression 14 has a value somewhat above 90°. The vector VII begins at the sidewall of the depression 14 and proceeds in the direction of the surface tension of the surface 36. The starting point of the surface tension vector VII lies at the boundary between printing fluid 34 and the sidewall of the depression 14. A middle region 38 of the surface 36 projects beyond the surface 8 of the printing drum 10 by a distance B. When the depression 14 is conducted past paper to be printed at a distance that is smaller than the distance B, then a wetting of the paper occurs. The adhesion forces between paper and printing fluid 34 are greater than the capillary forces between printing fluid 34 and depression 14. All of the printing fluid 34 is therefore sucked from the depression 14 and inks a region on the paper that is provided for a picture element.

Figure 2:
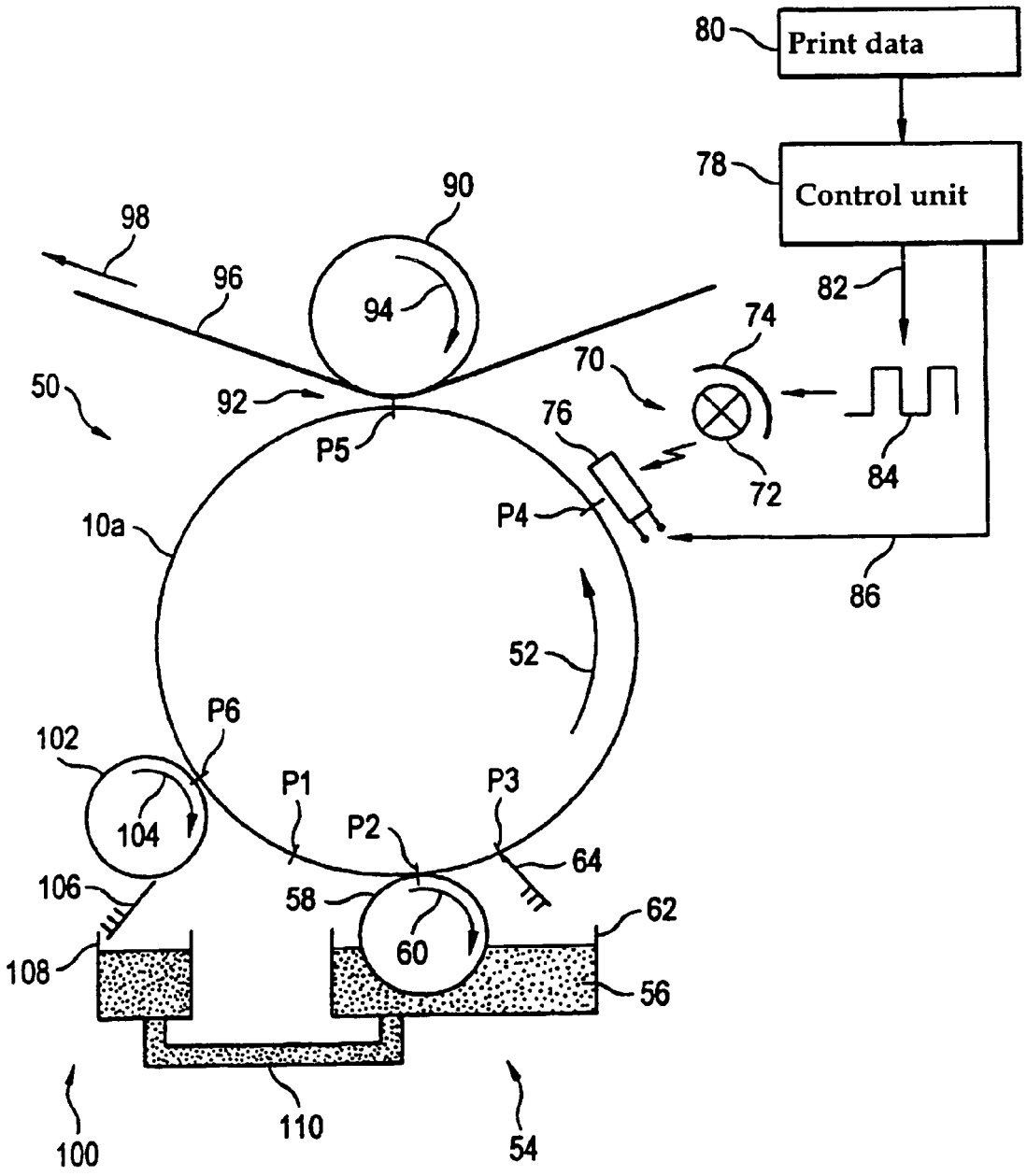
FIG. 2 illustrates a printing unit of a printer.

FIG. 2 shows a printing unit 50 of a printer. A printing drum 10*a* rotates counter-clockwise—see arrow 52. The devices explained below are successively arranged along the rotational direction of the printing drum 10*a*.

At the beginning of a revolution of the printing drum 10*a*, the depressions extending in the longitudinal direction of the printing drum 10*a* for printing a line are free of printing fluid—see position P1. Ink 56 is filled into the depressions of a row at an inking station 54. The inking station 54 contains a scoop drum 58 whose axis proceeds parallel to the axis of the printing drum 10*a*. At position P2, the surface of the scoop drum 58 touches the surface of the printing drum 10*a*. The scoop drum 58 turns in a direction opposite the printing drum 10*a*—see arrow 60. The lower part of the scoop drum 58 immerses into the ink 56 held by a reservoir 62, so that the surface of the scoop drum 58 is moistened with ink when it reaches the position P2. As a result of the capillary forces, the ink 56 is sucked from the surface of the scoop drum 58 into the depressions 12, 14 of the printing drum 10*a* that are located at the position P2.

A doctor blade 64 with which the surface of the printing drum 10*a* is swept so that no ink remains on the surface of the printing drum 10*a* outside the depressions is located at a position P3. After being swept with the doctor blade 64, the ink in all depressions has a respectively inwardly arced surface.

Due to the rotation of the printing drum 10*a*, the depressions of a row filled with ink 56 are subsequently transported to a position P4 at which an exposure device 70 alters the surface tension in selected depressions. The exposure device 70 contains a tubular photoflash 72 whose longitudinal axis is arranged parallel to the longitudinal axis of the printing drum 10*a*. A reflector 74 that extends along the photoflash lamp 72 and has an arcuate cross-section is located at that side of the photoflash lamp 72 facing away from the printing drum 10*a*. The photoflash lamp 72 is located approximately in the focus of the reflector 74. The exposure device 70 also contains a row of ceramic cells 76 arranged next to one another whose transparency can be varied with the assistance of a control voltage. Exactly one ceramic cell 76 is located opposite each depression when exposing a row of depressions at the position P4. The ceramic cells 76 are a matter of transparent, ferro electric ceramic laminae. Such ceramic laminae are known from optoelectronics. For example, European Letters Patent EP 0 253 300 B1 discloses such ceramic laminae as PLZT elements. However, opto-electronic elements that work according to the Kerr principle are also employed.

The exposure device 70 is controlled by a drive device 78 dependent on printing data 80 that define the picture elements of the print image to be printed. A first output line 82 of the drive device 78 carries a clock signal 84 that clocks the photoflash lamp 72 synchronously with the rotation of the printing drum 10*a*, so that each row of depressions that is moved past the position P4 is irradiated exactly once by the photoflash lamp 72.

Output lines 86 lead from the drive device 78 to individual ceramic cells 76 of the row of ceramic cells 76. The drive unit 78 drives the ceramic cells 76 such that a ceramic cell 76 under observation is light permeable when the depression lying opposite the corresponding ceramic cell contains ink that is to be employed for printing at a position P5 given the next pass. The light coming from the photoflash lamp 72 can then proceed through the corresponding ceramic cell 76 and onto the ink. Tensides that are situated on the surface of the ink are evaporated due to the photo-energy. The result is that the surface tension of the ink rises and the wetting angle increases. When, in contrast, the ink situated in a specific depression is not to be employed for printing a picture element, then the ceramic cell 76 lying there opposite is blacked out with the assistance of the drive device 78, so that no light from the photoflash lamp 72 can impinge the depression. The surface tension and the wetting angle of the ink remain unmodified.

As explained above with reference to FIG. 1, there are depressions at the position P4 after the passing of a row of depressions wherein the surface of the printing fluid has the condition I. The surface of the ink has the condition II in other depressions.

A transfer printing zone 92 is located at the position P5 between the printing drum 10*a* and a transport roller 90. The longitudinal axis of the transport roller 90 lies parallel to the axis of the printing drum 10*a*. The transport roller 90 is turned in a direction opposite the printing drum 10*a* by a transport mechanism (not shown), see arrow 94. Continuous form paper is transported in a conveying direction 98 between printing drum 10*a* and transport roller 90. The continuous form paper 96 lies against the surface of the transport roller 90.

Continuous form paper 96 and the surface of the printing drum 10*a* have the same velocity in the region of the transfer printing zone 92, so that they are at rest relative to one another. That surface of the continuous form paper 96 facing toward the printing drum 10*a* has a spacing from the surface of the printing drum 10*a* in the transfer printing zone 92 that is smaller than the spacing B, see FIG. 1. The spacing B assures that no abrasion will arise at the continuous form paper 96 and at the printing drum 10*a*. In another exemplary embodiment, the continuous form paper is pressed against the printing drum 10*a* by a soft pressure roller. In the region of the transfer printing zone, the continuous form paper 96 is printed at locations that lie opposite depressions that have a high surface tension and, thus, have a great curvature at the surface, condition II.

After the depressions are transported past the position P5, there are depressions in which ink 56 is still situated. The ink 56 was removed from other depressions when printing in the transfer printing zone 72. A cleaning station 100 is located at a position P6. The cleaning station 100 contains a cleaning drum 102 whose longitudinal axis lies parallel to the longitudinal axis of the printing drum 10*a*. The cleaning drum turns in a direction opposite the printing drum 10*a*, see arrow 104. The surface of the cleaning drum 102 and the surface of the printing drum 10*a* touch at the position P6. The surface of the cleaning drum 102 is fabricated of an absorbent material which absorbs ink 56 from the depressions in which ink has remained. Ink that has previously been in the depressions on the printing drum 10*a* is squeegeed from the cleaning drum 102 with the assistance of a doctor blade 106. The ink that has been squeegeed off runs into a collecting basin 108 arranged under the doctor blade 106. After being transported past the position P6, the depressions on the transfer printing drum 10*a* are again in their original condition, as was explained above for the position P1. An interconnecting feeder 110 via which the ink dripping down from the doctor blade 106 returns into the reservoir 62 is located between the collecting basin 108 of the cleaning station 100 and the reservoir 62 of the inking station 54. An ink circulation for ink that was not used is thus closed via the interconnecting feeder 110.

Figure 3A:
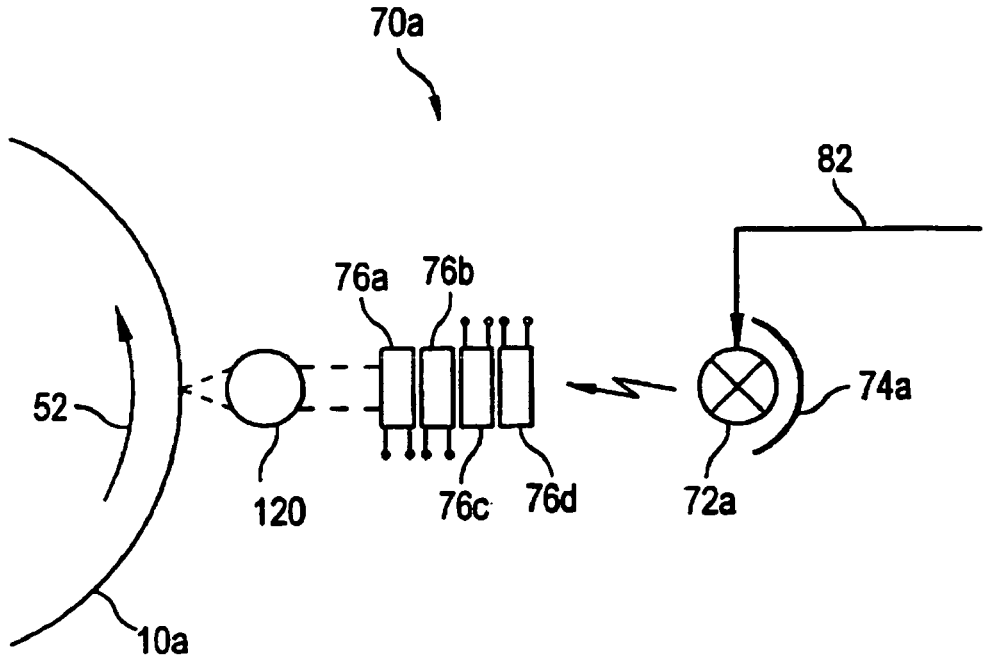
FIG. 3A shows an irradiation device for varying the surface tension of a printing fluid.

FIG. 3A shows a second exemplary embodiment for an exposure device 70*a* that is employed instead of the exposure device 70. The exposure device 70*a* likewise contains a photoflash lamp 72*a* and a reflector 74*a* that have the same structure as the photoflash lamp 72 or the reflector 74. However, four rows of ceramic cells 76*a*, 76*b*, 76*c* and 76*d* are arranged between photoflash lamp 72*a* and printing drum 10*a* in the exposure device 70*a*. FIG. 3A shows a side view onto the rows of ceramic cells 76*a* through 76*d* that are arranged in the light path between photoflash lamp 72*a* and printing drum 10*a*, so that the light coming from the photoflash lamp 72*a* successively passes through ceramic cells 76*a* through 76*d* of different rows. What is referred to as a self-focusing lens 120 is situated between the row of ceramic cells 76*a* and the printing drum 10*a*. Such lenses are manufactured of gradient fibers and are known by the trade name SELFOC (also see EP 0 253 300 B1).

Figure 3B:
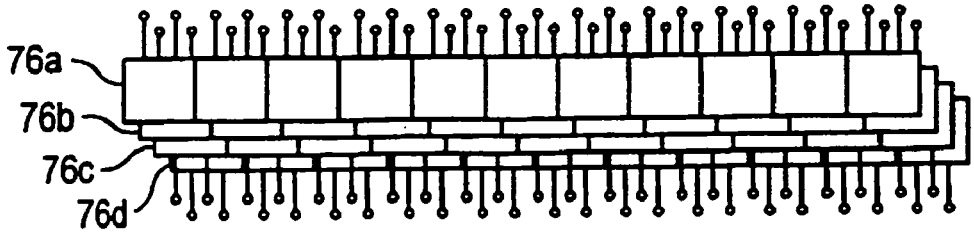
FIG. 3B shows a print perspective view of rows of ceramic cells.

FIG. 3B shows a front perspective view of the rows of ceramic cells 76*a* through 76*d* lying behind one another. Ceramic cells 76*a* through 76*d* lying behind one another are respectively offset by a quarter length of a ceramic cell relative to one another. As a result of this offset, printing drums 10*a* can also be exposed wherein neighboring depressions have a very small spacing A. The terminals of the ceramic cells contained in the rows of ceramic cells 76*a* through 76*d* are connected to the drive device 78, so that individual ceramic cells can be separately driven. The arrangement of the ceramic cells 76*a* through 76*d* shown in FIGS. 3A and 3B enable a higher printing speed or a higher resolution of the printing event given an unaltered printing speed.

Figure 4:
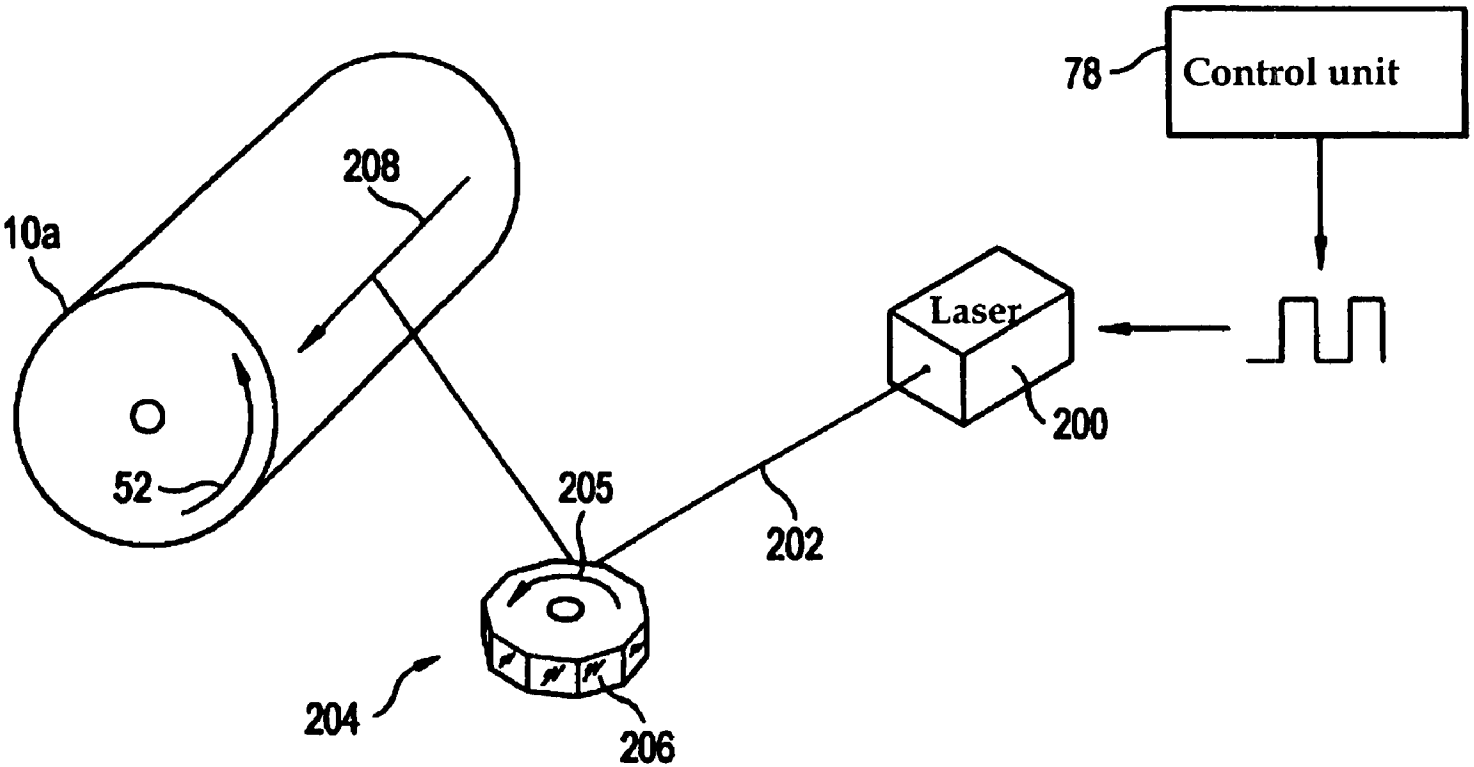
FIG. 4 shows an irradiation unit working according to the scanning principle for varying the surface tension of the printing fluid.

FIG. 4 shows an exposure unit 70*b* working according to the scanning principle that is employed instead of the exposure unit 70. A laser 200 driven by the drive unit 78 emits a laser beam 202 that impinges a polygonal mirror 204. The polygonal mirror 204 turns in a counter-clockwise direction along its longitudinal axis, see arrow 204. Upon rotation of the polygonal mirror 204, the laser beam 202 successively impinges lateral faces 206 of the polygonal mirror 205. Due to the rotation of the polygonal mirror 204, the laser beam 202 is successively reflected by different lateral faces 206 of the polygonal mirror 204 and sweeps across the printing drum 10*a* along a principal scan direction 208 in a row direction of the depressions. The drive unit 78 drives the laser 200 such that the laser beam 202 impinges depressions to which picture elements to be presented black are allocated. When sweeping across depressions to which white picture elements are allocated, the laser beam 202 is blacked out.

A motion in a secondary scan direction, see arrow 52, is generated due to the rotation of the printing drum 10*a*, so that the next row with depressions is irradiated given incidence of the laser beam 202 onto the next lateral face 206 of the polygonal mirror.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A method for transferring printing fluid onto a carrier material, comprising the steps of:

defining with print data picture elements of a print image to be printed onto the carrier material;

influencing a surface tension of a prescribed volume of a printing fluid when printing a picture element dependent on the print data belonging to the picture element such that without significant change in volume, the printing fluid having a first surface tension causing a change of a surface shape of a surface of the printing fluid so that a portion of the surface contacts the carrier material to moisten the carrier material, and does not touch the carrier material when the printing fluid has a second surface tension of said surface deviating from the first surface tension resulting in a shape of said surface such that the surface is positioned away from contact with the carrier material;

the first surface tension having a first value at which the surface of the printing fluid is arced outward into contact with the carrier material; and the second surface tension having a second value at which the surface of the printing fluid is one of planar and arced inward away from contact with the carrier material.

2. The method according to claim 1 wherein the surface tension is varied by varying a temperature of the printing fluid.

3. The method according to claim 2 wherein additives to the fluid evaporate upon variation of the temperature.

4. The method according to claim 1 wherein the surface tension is varied by varying an ionization of the printing fluid.

5. The method according to claim 1 wherein the surface tension of a prescribed volume of the printing fluid is varied.

6. The method according to claim 5 wherein the volume is dimensioned such that it corresponds to a volume of printing fluid to be applied onto a picture element having a color of the printing fluid.

7. The method according to claim 6 wherein the volume is prescribed by a volume capacity of a depression.

8. The method according to claim 7 wherein a plurality of the depressions are arranged in matrix-like fashion on a drum-shaped surface.

9. The method according to claim 7 wherein the surface tension is influenced due to action of a radiation source directed through an aperture of the depression into an inside of the depression.

10. The method according to claim 1 wherein the surface tension is varied with the assistance of at least one of a temporally and topically drivable radiation source.

11. The method according to claim 2 wherein the printing fluid for all picture elements initially has a lower surface tension that is raised dependent on the print data.

12. The method according to claim 1 wherein the first surface tension is greater than the second surface tension.

* * * * *